United States Patent [19]

Adlon et al.

[11] Patent Number: 4,879,934

[45] Date of Patent: Nov. 14, 1989

[54] SELECTIVE WIRE FEED FOR A PLURALITY OF WIRES

[75] Inventors: Daniel T. Adlon; Kenneth F. Folk, both of Harrisburg, Pa.

[73] Assignee: AMP Incorporated, Harrisburg, Pa.

[21] Appl. No.: 107,147

[22] Filed: Oct. 8, 1987

[51] Int. Cl.[4] ..... B25D 1/08; B65H 51/10

[52] U.S. Cl. ..... 83/76.9; 83/111; 83/156; 83/261; 83/272; 83/279; 83/282; 83/422; 83/443; 83/444; 83/950; 226/109

[58] Field of Search ..... 83/71, 261, 272, 282, 83/111, 156, 422, 444, 443, 279, 926 B; 226/108, 109

[56] References Cited

U.S. PATENT DOCUMENTS

| | | | |
|---|---|---|---|
| 1,092,124 | 3/1914 | Pledger | 83/272 X |
| 3,766,624 | 10/1973 | Grebe et al. | 29/203 MW |
| 3,776,081 | 12/1973 | Becker | 83/272 |
| 4,014,233 | 3/1977 | Wölfinger et al. | 83/272 X |
| 4,347,651 | 9/1982 | Inoue et al. | 29/33 M |
| 4,354,626 | 10/1982 | Brandewie et al. | 226/109 |

*Primary Examiner*—Frank T. Yost
*Assistant Examiner*—Hien H. Phan
*Attorney, Agent, or Firm*—Frederick W. Raring; William B. Noll

[57] ABSTRACT

A selective wire feed for feeding any one of a plurality of wires which are arranged in pairs, each pair having a first wire and a second wire. Each wire pair has a feeding unit associated therewith which comprises a driven belt and two idler belts. The idler belts are movable between a feeding position and a non-feeding position. A specific wire is fed by moving its associated feeding belt to its feeding position and actuating the driven belt so that the wire is fed by the two belts. A wire guide is provided and has convergent passageways which extend to a wire outlet. A cutter is provided adjacent to the outlet so that a wire which has been fed can be cut. Thereafter, the wire which has been fed can be retracted by reversing the direction of the driven belt.

20 Claims, 11 Drawing Sheets

SELECTIVE WIRE FEED FOR A PLURALITY OF WIRES

FIELD OF THE INVENTION

This invention relates to wire feeding devices of the type which are capable of selectively feeding any one of a plurality of wires in an array.

BACKGROUND OF THE INVENTION

A commonly known type of lead making machine, as shown for example in U.S. Pat. Nos. 3,019,697, and 4,489,476 comprises a wire feeder for feeding wire from an endless source, such as a barrel or reel, through and beyond a cutting and stripping zone. After the wire has been fed, it is cut to produce a cut lead with the leading end of the wire extending from the endless source to a location adjacent to the cutter. Machines of the type shown in the above-identified U.S. patents thereafter present the cut ends of both the lead and the wire extending from the source to crimping machines so that terminals can be crimped onto the wire ends.

Most, if not all of the machines of the type described above are capable of feeding only a single wire (or perhaps two wires in tandem) and are not capable of feeding any one of a plurality of wires which would be drawn from a plurality of endless sources. It would be desirable to add to machines of the type described above the capability of selectively feeding any one of a plurality of wires for the reason that it would then be possible to produce, during continuous operation of the machine, a series of leads having wires of different colors or different gauges which would be used to produce a specific harness. Recent advances in the harness making arts require that all of the leads for a given harness be produced immediately prior to the assembly of these leads to each other and if all of the leads required for a specific harness are to be produced by the same machine and within a short time cycle, it is obvious that the machine must be capable of selectively feeding any one of the types of wires required in the harness.

There are several difficulties which must be overcome in order to provide a multiple wire feeding system to lead making machines of the type described or harness making machines employing the same features as the machines described above. For example, machines of the type described in the above-identified U.S. Pat. Nos. 3,019,697, and 4,489,476 require that after the wire extending from the source has been cut, it must be in a predetermined position so that it can then be presented by the machine to the crimping press which requires precise location of the wire between the crimping die and the crimping anvil. Most, if not all, of the known types of selective wire feeds which are known to the art require that the array of wires be in side-by-side, parallel, co-planar relationship and the known types of wire feeds are capable of only feeding these wires in the direction of their axes along straight line paths. At the end of a given feeding cycle for a specific wire then, the wire end will be at a location which is spaced from the location at which any of the other wires in the array would be located, see for example U.S. Pat. Nos. 4,043,494 and 4,192,207.

The present invention is directed to the achievement of an improved selective wire feed for feeding any one of a plurality of wires and which locates the end of a fed wire in a precisely predetermined position regardless of which wire in the array is fed. The invention is further directed to the achievement of an improved feeding apparatus and improved control systems for feeding devices.

THE INVENTION

One embodiment of the invention comprises a wire feeding unit for selectively feeding either one of a first wire and a second wire, the wires being in parallel relationship. The feeding unit is characterized in that first, second, and third endless feeding surfaces are provided which are in side-by-side relationship with the third feeding surface between the first and second feeding surfaces. The first and third feeding surfaces have first opposed portions which function as first wire feeding portions. The first wire is between the opposed portions of the first wire feeding portions. The second and third surfaces have opposed portions which function as second wire feeding portions and the second wire is between these opposed portions. Each of the feeding surfaces is movable along its length in both directions of its length, the opposed portions of each of the first and second wire feeding portions being relatively laterally displaceable towards and away from each other between a feeding position and a non-feeding position. The opposed portions of each of the wire feeding portions are against each other when in the feeding position and are spaced apart when in the non-feeding position. Actuating means are provided for displacing either of the first and second feeding portions to their feeding positions and for moving one of the endless surfaces which is in its feeding position whereby either one of the wires can be selectively fed in a common direction by displacing the wire feeding portions which are associated with the one wire to their feeding position and thereafter moving one of the associated surfaces along its length. Advantageously, each of the feeding surfaces comprises an endless belt. In accordance with a preferred embodiment, the third endless feeding surface is a driven surface and the first and second endless surfaces are idler surfaces. The actuating means is effective, in this embodiment, to move only the third feeding surface.

In accordance with a further embodiment, wire guide means are provided for guiding the wires during feeding. The wire guide means is in alignment with the first and second wires and has convergent portions and a single wire passageway which extends to a wire outlet. The convergent portions extend to, and converge at, the single wire passageway whereby the wires are fed from the single wire outlet.

In accordance with a further embodiment, a wire cutter is provided proximate to the wire outlet and the actuating means is effective to actuate the cutter after a selected wire has been fed past the wire cutter. Advantageously, the actuating means further comprises feed control means for moving the driven surface in the one direction which will result in the feeding of a selected wire during a feeding interval and is also effective to move the driven surface in the opposite direction after a feeding interval whereby after a wire has been fed and cut, the selected wire can be retracted through the wire outlet and through the single wire passageway.

A further embodiment comprises wire feeding apparatus for selectively feeding one wire selected from either one of a first wire pair and a second wire pair, the first wire pair comprising a first pair first wire and a first pair second wire. The second wire pair comprises a second pair first wire and a second pair second wire. The feeding apparatus comprises first and second feeding units for the first pair and the second pair respectively. The feeding units and the actuating means are as described above. The first and second feeding units are in stacked and aligned relationship with the driven surface and the first and second idler surfaces for the first and second pairs of the first unit being beside the endless driven surface and the idler surfaces of the second unit respectively. Wire guide means as described above are preferably provided adjacent to the feeding units, the guide means having four convergent passageways for the four wires. The convergent passageways extend to a single wire passageway as described above which in turn extends to a wire outlet.

THE DRAWING FIGURES

Figure 4:
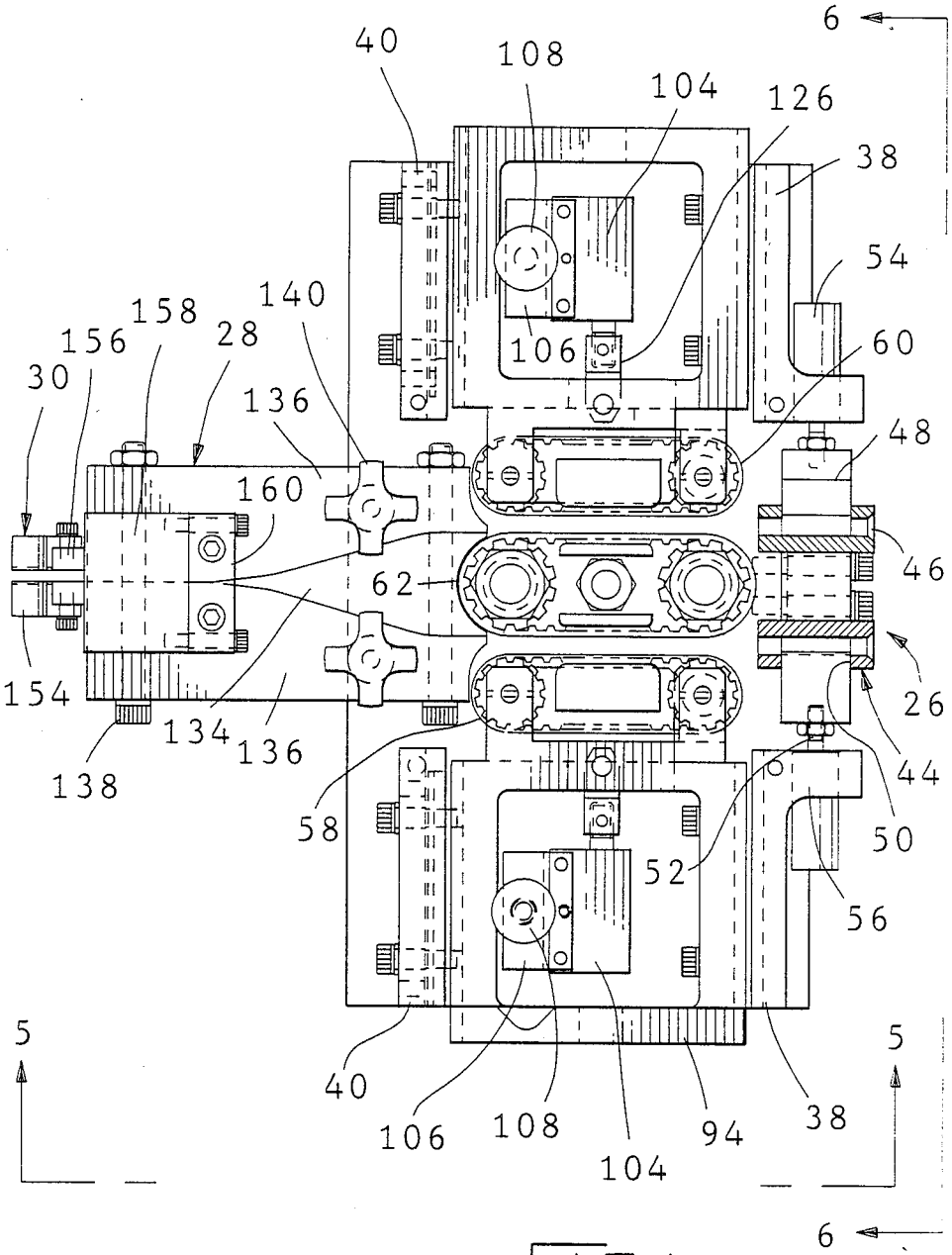
FIG. 4 is a top plan view with the cover plate removed.
Figure 5:
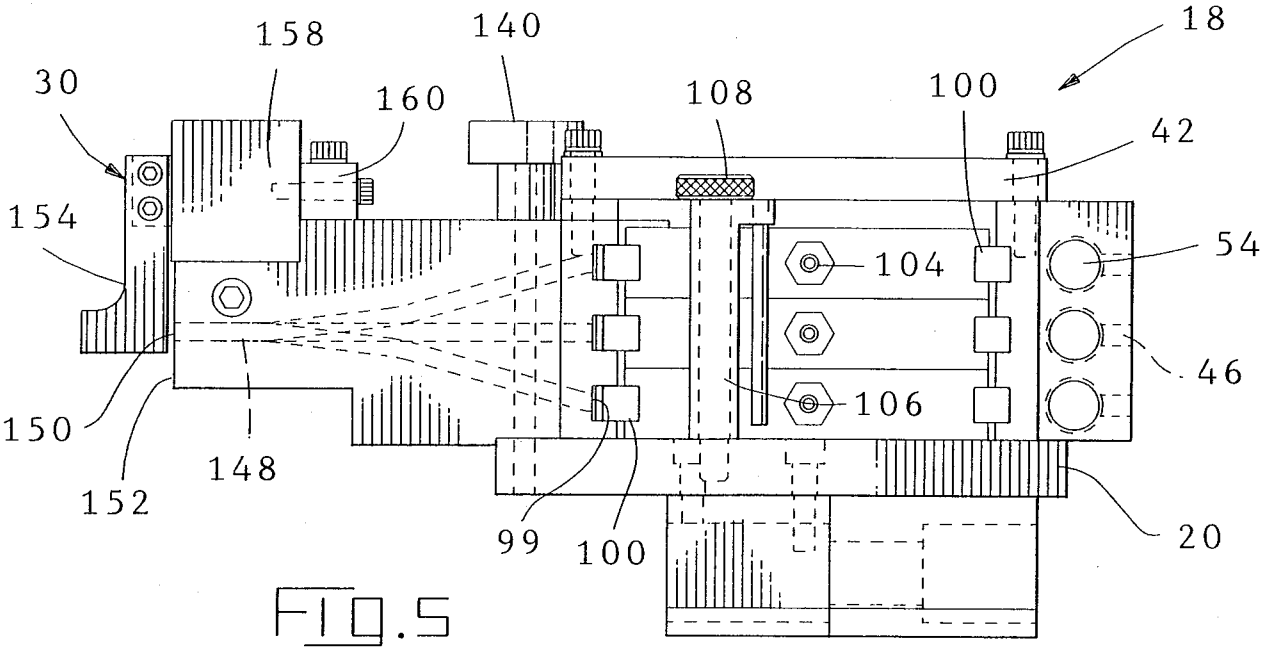
Figure 6:
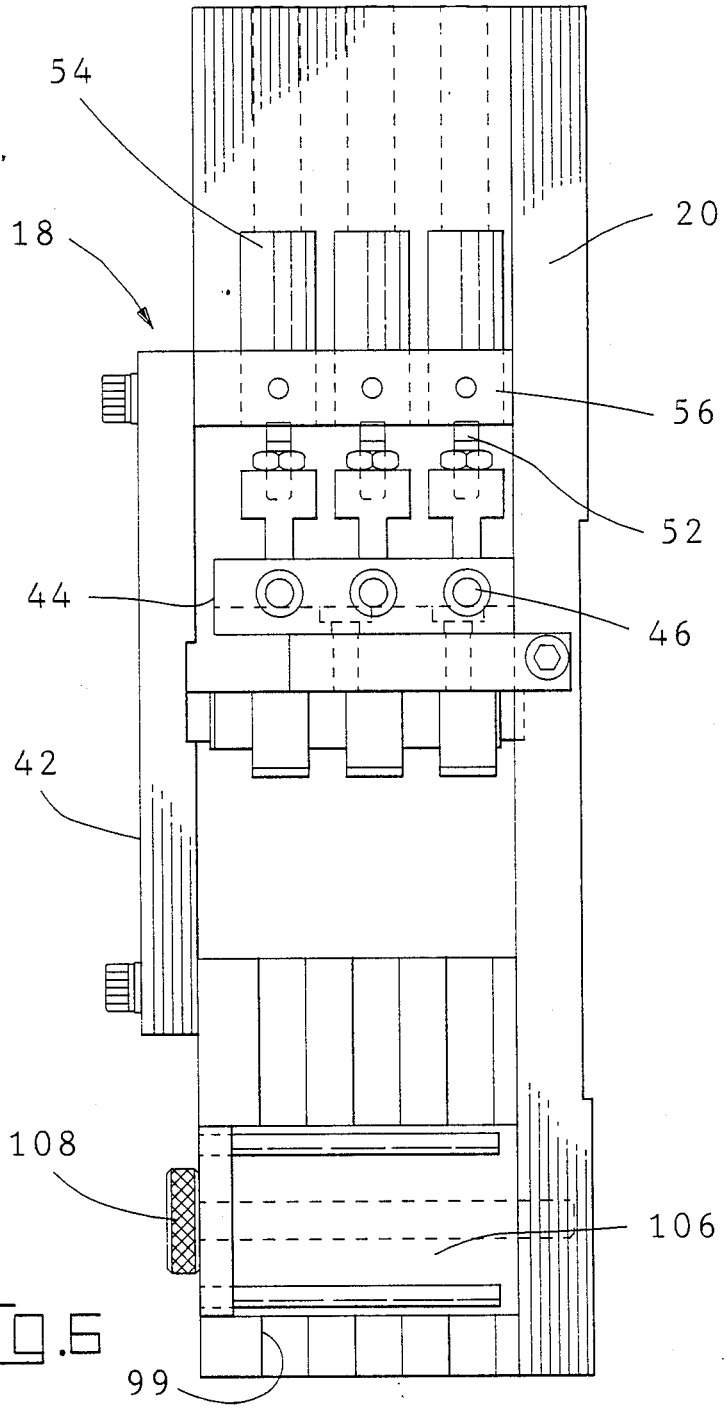

FIG. 5 and 6 are views looking in the direction of the arrows 5—5 and 6—6 of FIG. 4.

Figure 7:
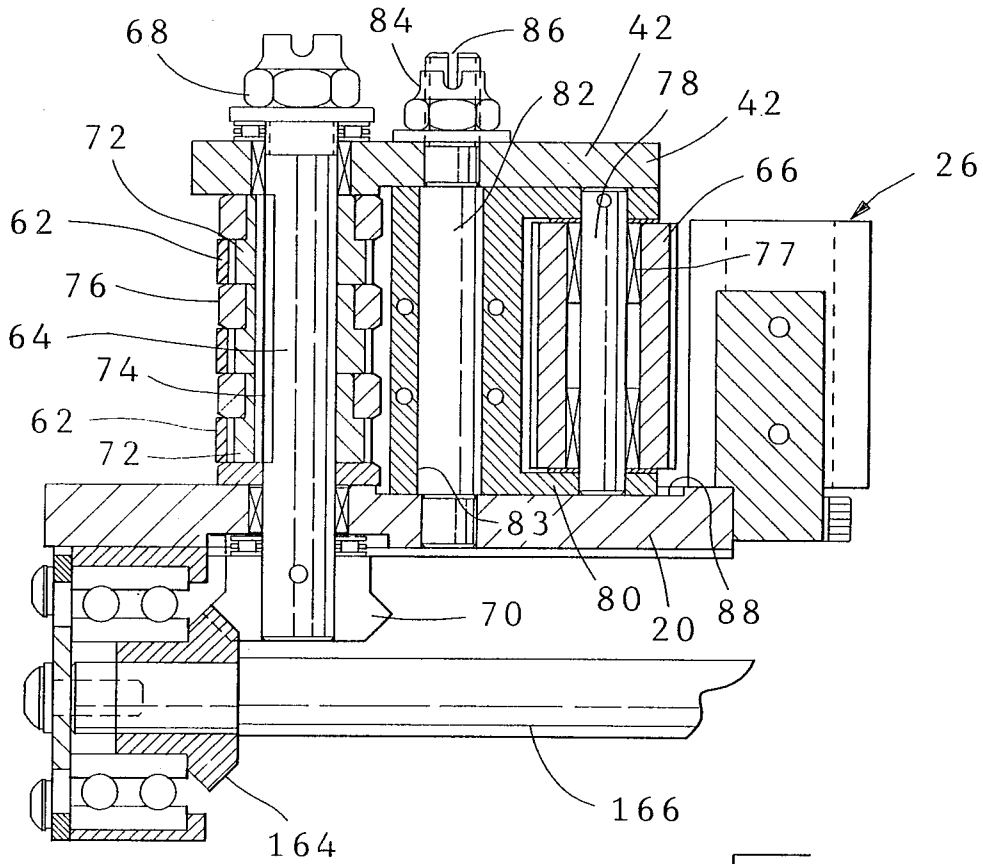

FIG. 7 is a sectional view on an enlarged scale of the driven belt assembly of the apparatus.

Figure 8:
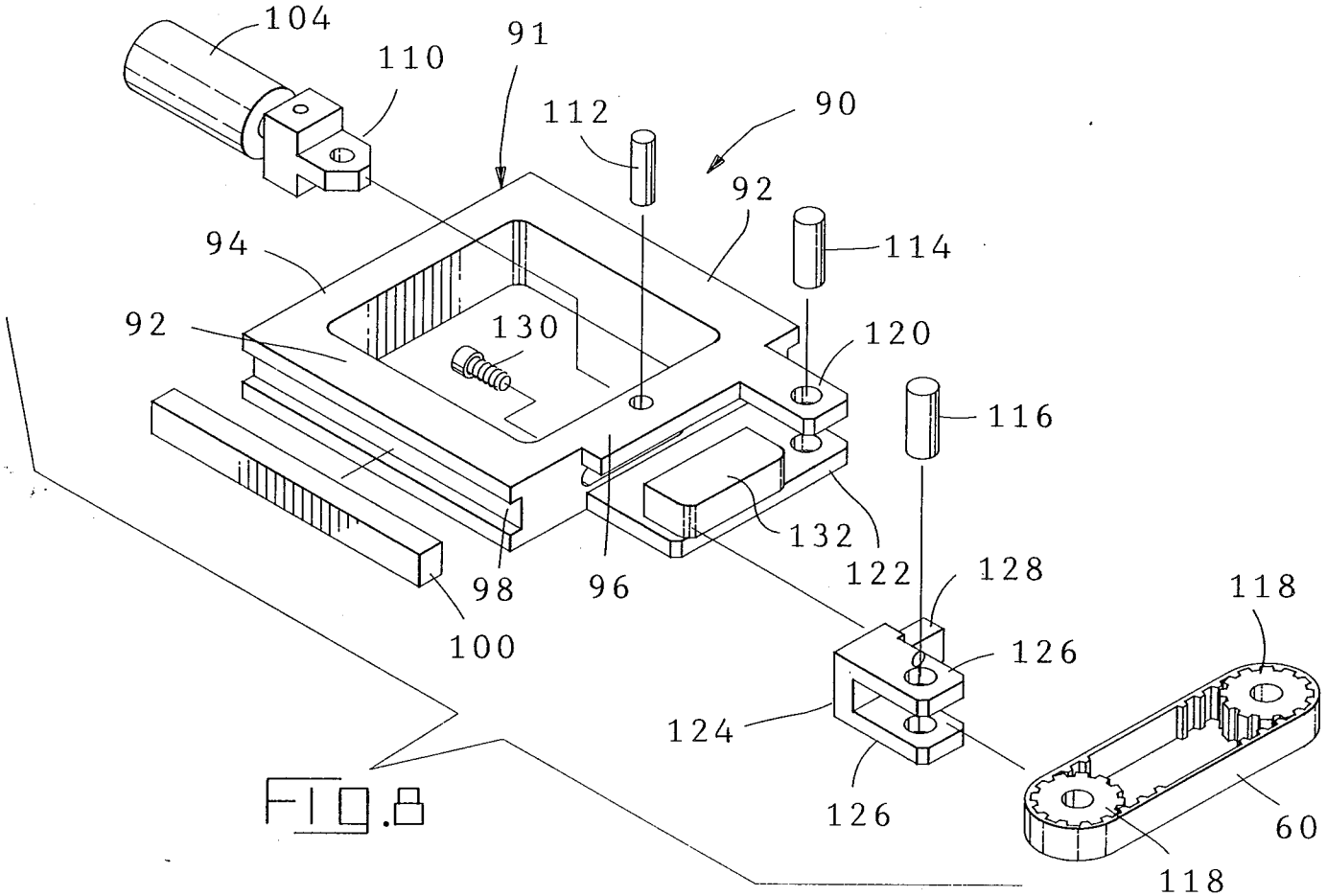
Figure 9:
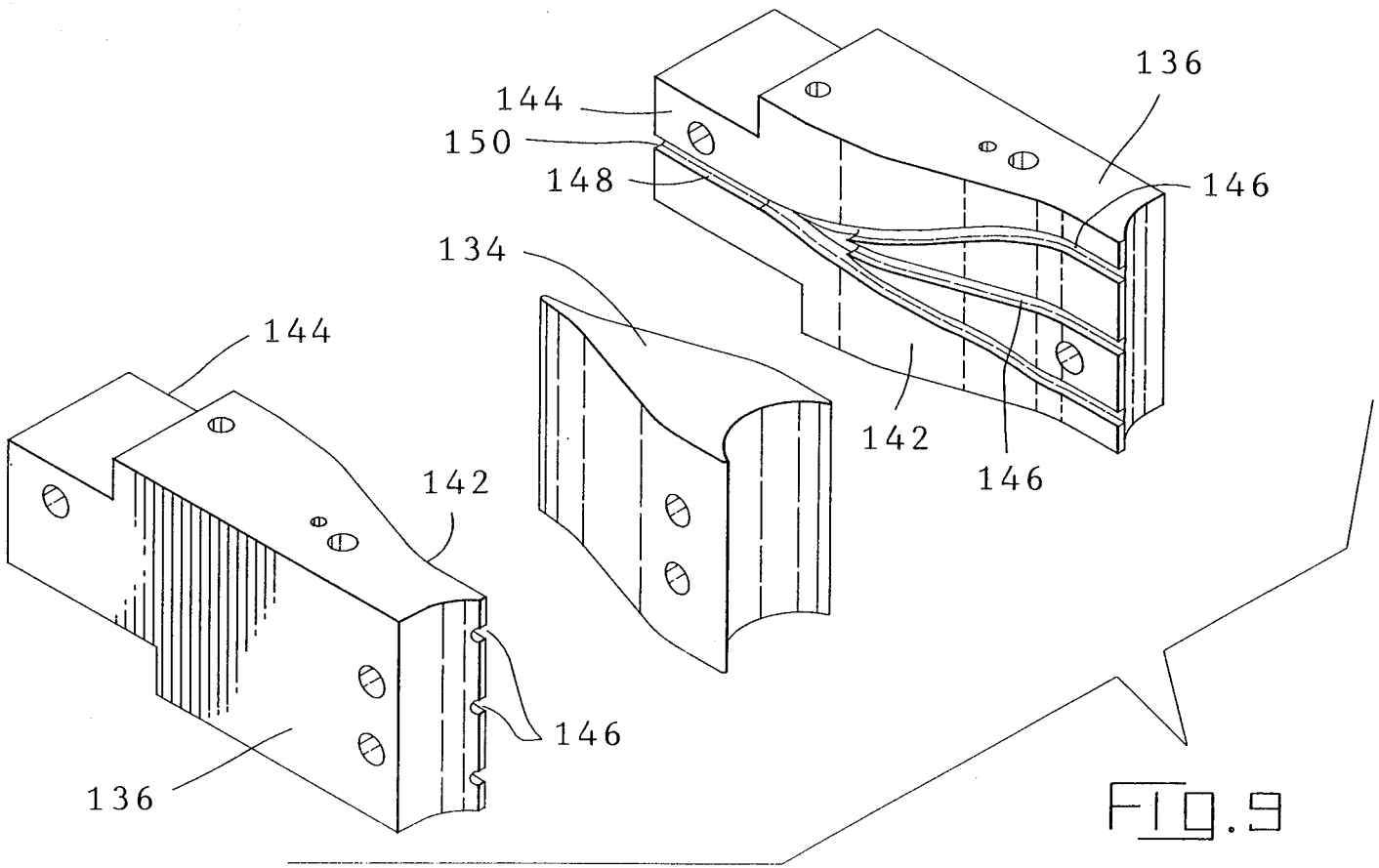

FIG. 8 is a perspective view with some parts exploded of an belt assembly which forms part of the apparatus. FIG. 9 is a perspective view of two of the blocks which comprise the wire guide section of the apparatus.

Figures 10, 11:
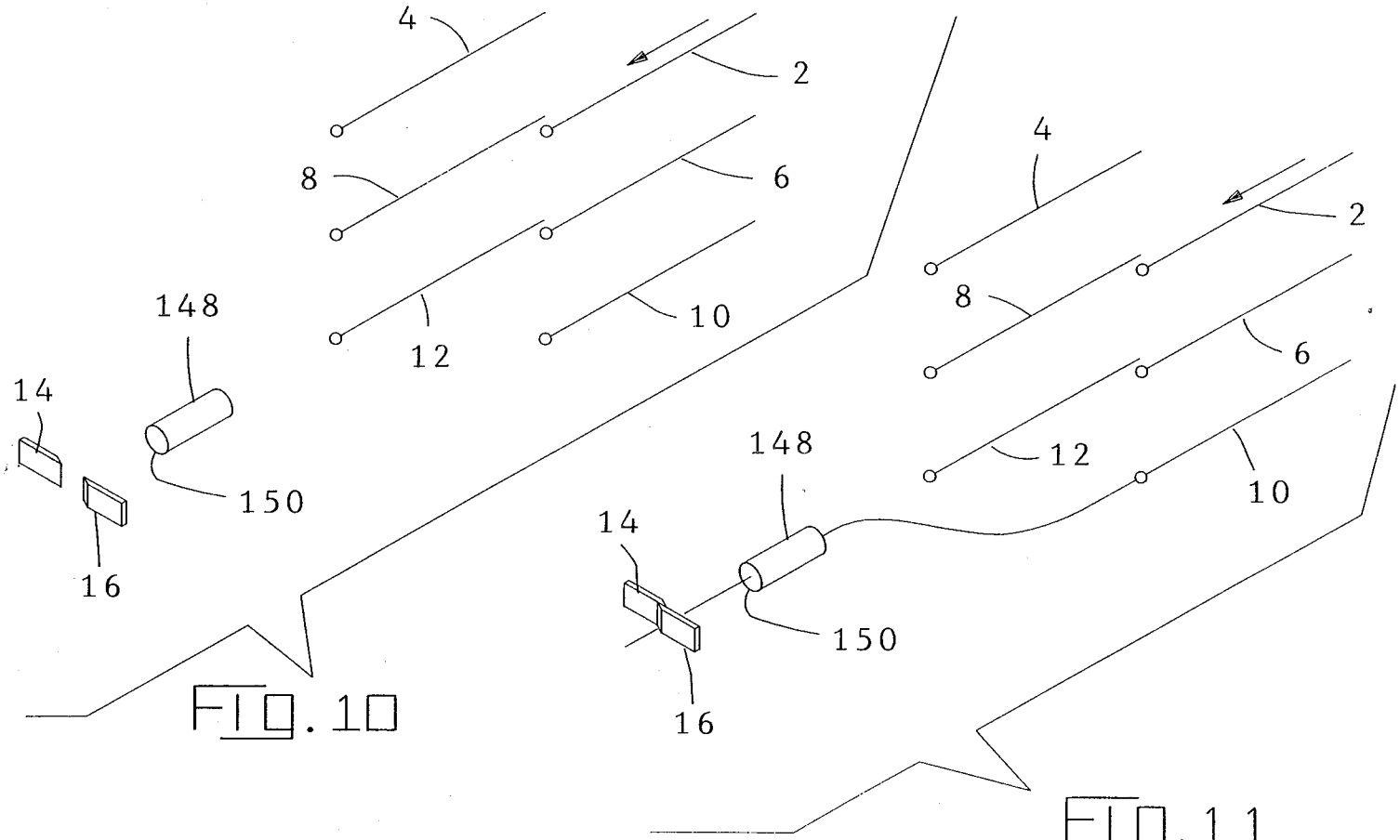

FIGS. 10 and 11 are diagrammatic views illustrating the manner in which a selected wire is fed during a feeding cycle of the apparatus.

Figure 12:
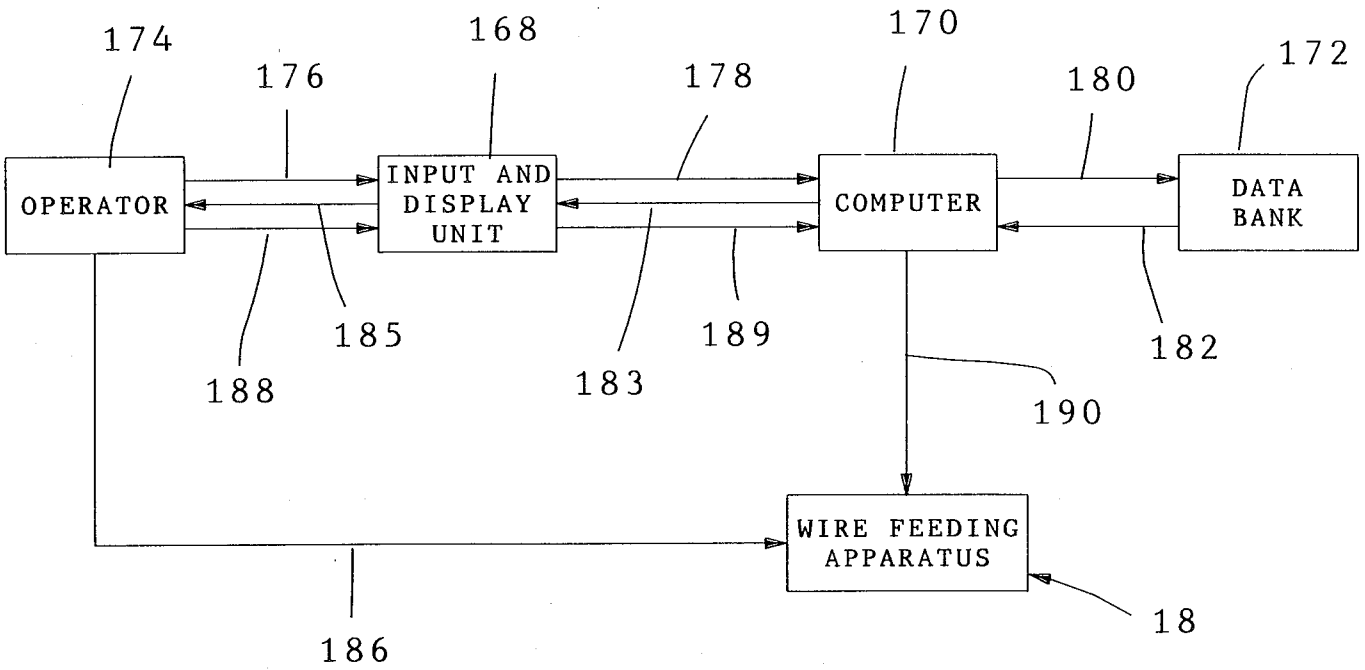

FIG. 12 is a block diagram of the control system for the apparatus.

THE DISCLOSED EMBODIMENT

FIGS. 10 and 11 illustrate the manner in which any one of six wires 2, 4, 6, 8, 10, 12 are fed during a feeding cycle of the apparatus. The wires are arranged in pairs, the wires 2, 4 being the first pair, the wires 6, 8 the second pair, and the wires 10, 12 the third pair. The wire 2 is identified as the first wire of the first pair and the wire 4 is the second wire of the first pair. Similarly, the wires 6 and 10 are the first wires of the second and third pairs and the wires 8 and 12 are the second wires of the second and third pair. At the beginning of the operating cycle, the ends of the wires will be aligned as shown. If it is desired to feed the wire 10 selectively, the apparatus feeds this wire from its normal position along a path which extends to one end of a wire passageway 148. During this feeding operation, the wire must be fed not only axially but laterally towards the passageway as indicated in FIG. 11. The wire is fed into the passageway 148 through the outlet 150 of the passageway and past a pair of normally open severing blades 14, 16. At the conclusion of the feeding cycle, the blades 14, 16 are closed to cut the wire so that a cut lead is produced which extends leftwardly from the cutter. The cut end of the wire 10 can then be withdrawn or retracted to its starting position and during the next feeding cycle, a different wire can be fed along a convergent path towards the single wire passageway 148.

Figure 1:
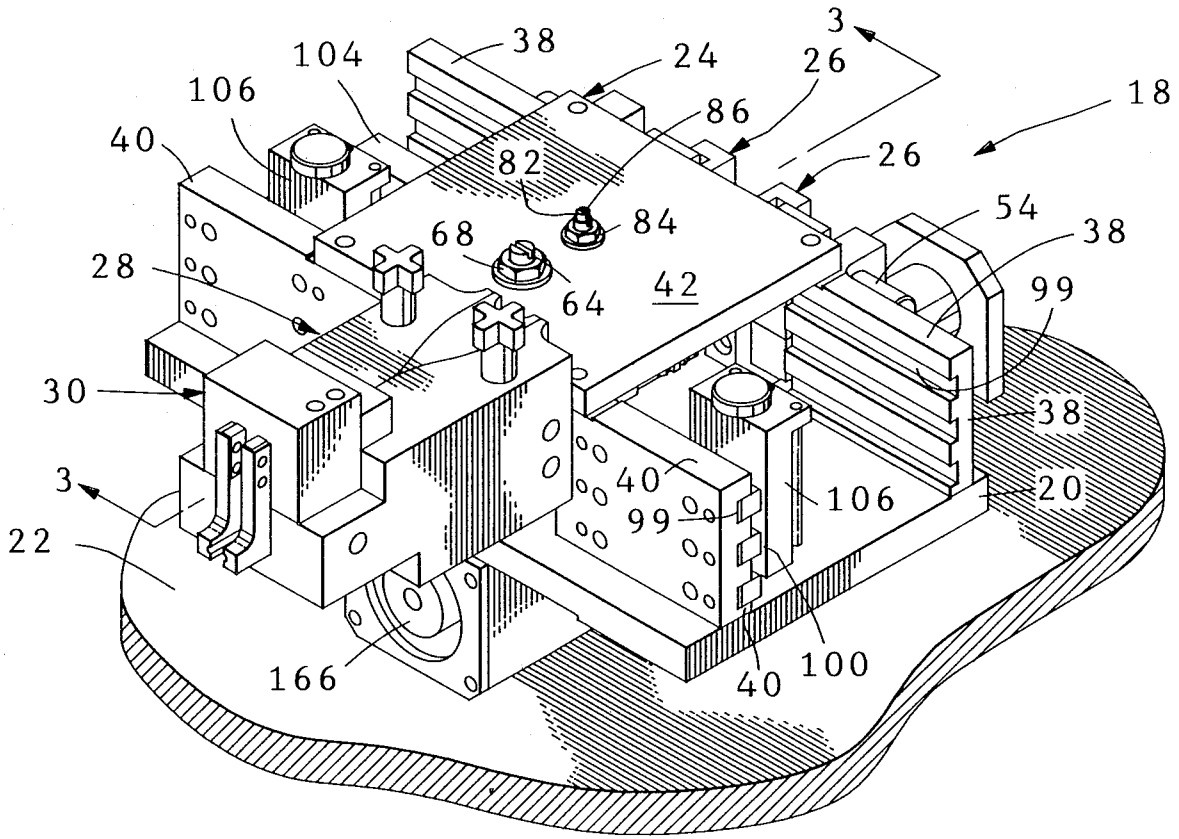
FIG. 1 is a perspective view of a feeding apparatus in accordance with the invention.
Figure 2:
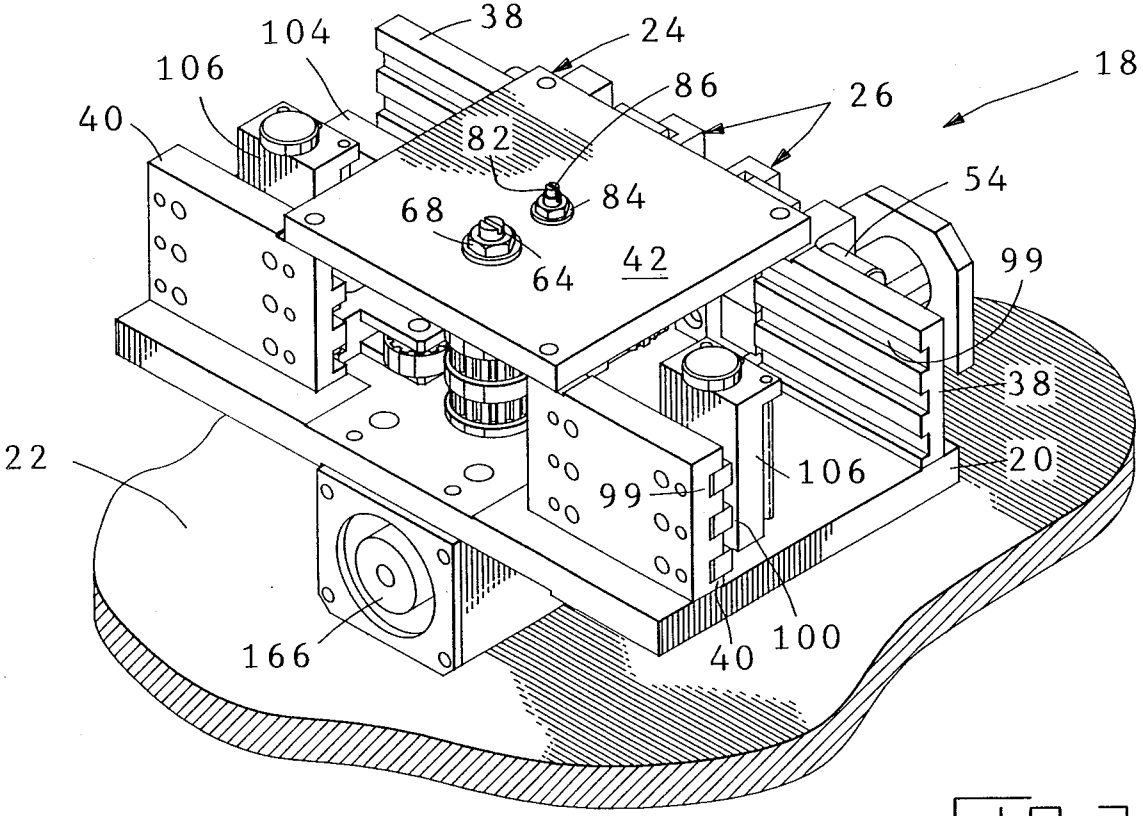
FIG. 2 is a view similar to FIG. 1 but with some of the parts exploded from each other.
Figure 3:
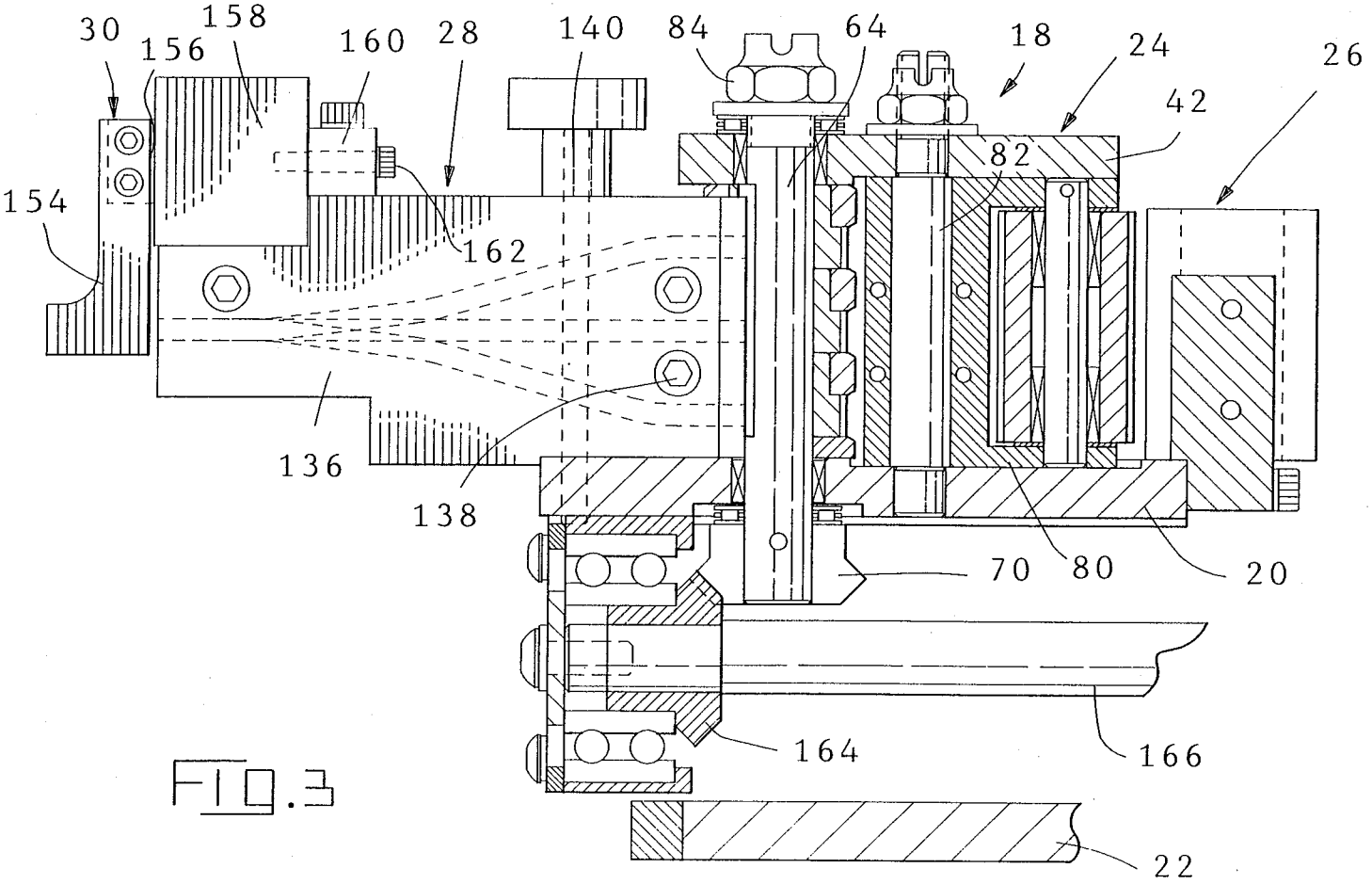
FIG. 3 is a sectional side view looking in the direction of the arrows 3—3 of FIG. 1.

The feeding apparatus 18, FIGS. 1–3, is supported on a base plate 20 which is in turn supported above a support platform 22. The support platform may be part of the harness making or lead making machine of which the wire feeding apparatus is a part. The apparatus 18 comprises generally a wire feeding section 24, an upstream wire clamping section 26, a wire guide section 28, and a downstream wire clamp 30. The terms "upstream" and "downstream" refer to the direction of wire feed which is from right to left as viewed in FIG. 3. The wire is supplied from endless sources such as barrels or reels.

A frame structure is mounted on the base plate 20 and comprises two pairs of spaced-apart opposed plates 38, 40 and 38', 40'. A cover plate 42 is secured to the upper edges of these plates and is over the feeding belts which are described below. The machine is substantially symmetrical about a center line extending therethrough in the direction of wire feed and the same reference numerals, with some exceptions, will be used to indicate corresponding structural elements on each side of the center line.

The wires are guided into the feeding section by an entry guide assembly 44, FIGS. 4 and 6, which has openings 46 extending therethrough, one opening being provided for each of the wires. Each of the openings 46 has a clamping block 48 associated therewith in order to clamp the wire in the opening when it is not being fed. The clamping blocks extend through side openings 50 in the entry guide assembly which communicate with the passageways 46. The clamping blocks 48 are secured to the ends of piston rods 52 which extend in turn from piston cylinders 54. These cylinders are mounted on ears 56 which are integral with the side plates 38, as shown best in FIG. 4. All of the clamping blocks are normally in clamping relationship with their associated wires, excepting during a feeding interval when one of the clamping blocks will be in its retraced position in order to permit feeding of the wire.

The feeding section comprises three feeding units, one feeding unit being provided for each of the pairs of wires. The feeding units are substantially identical to each other so that a description of one will suffice for all.

Each feeding unit comprises first and second belts 58, 60 which are idler belts and a third belt 62 which is a driven belt, the driven belt being between the two idler belts. As shown best in FIG. 7, the drive belts or third belts 62 of the feeding units extend around a common drive shaft 64 and a common idler shaft 66. The drive shaft extends through the cover plate 42 and has a locknut 68 on its upper end. The lower end of the drive shaft extends through the plate 20 and has a bevel gear 70 on its end which meshes with a bevel gear 164 on a shaft 166. The shaft 166 in turn is rotated by a printed circuit motor (not specifically shown) which is under the control of the control system described below. Separate sprockets 72 are provided as shown which is keyed to the shaft by key 74. Guides 76 are provided between adjacent belts.

The idler shaft 66 is rotatably supported by means of bearings 77 on a fixed pin 78 which has its ends fixed in an adjustable U-shaped support frame 80. This U-shaped support frame is between the opposed surfaces of the plates 20 and 42, a recess 88 being provided in the surface of the base plate 20 to permit movement of the support frame for purposes of adjusting the tension in the belt. The tension is adjusted by means of an eccentric shaft 82 which extends through an opening 83 in the web portion of the frame member so that rotation of the eccentric shaft will cause movement of the frame member one way or another to increase or decrease the tension in the belt. The eccentric shaft has a kerf 86 in its upper end which is above the cover plate 20 and has a locknut 84 threaded onto its end so that it can be locked in a given position after the required tension has been imparted to the shaft. The printed circuit motor which drives the power shaft 166 and the driven shaft can be rotated, under the influence of the control system, in either direction so that the belt can be driven in either direction.

Each of the feeding units has two idler belt assemblies 90, FIG. 8, one assembly being provided for each of the first and second wires of the associated wire pair. Each wire assembly comprises an open rectangular frame 91 having side rails 92, a back rail 94, and a front rail 96 which is adjacent to the driven belt. Slots 98 are provided in the outwardly facing surfaces of the side rails 92 and slots 99 are provided in the opposed faces of the associated plates 38, 40. A guide bar 100 is mounted by suitable fasteners in the associated slot of one of the plates 38 or 40. This guide bar is dimensioned to enter the opposed slot in the side rail of the associated frame. The other side rail of the frame has one of the guide bars 100 mounted therein so that it enters the slot of the associated frame plate. These guide bars are advantageously of a graphite filled polyester having a low friction coefficient.

The idler belt assemblies are individually movable between a feeding position and a non-feeding position, the idler belt being substantially against the associated driven belt when in its feeding position and being spaced from the associated driven belt when it is in its non-feeding position. Movement of the individual idler belt assemblies between their two positions is achieved by means of air cylinders 104, a separate air cylinder being provided for each of the belt assemblies. The air cylinders are supported on a column 106 which are secured to the base plate 20 by a fastener 108 as shown in FIG. 5. The air cylinder associated with a particular frame member has a coupling block 110 on the end of its piston rod which in turn is pivoted at 112 to the rail 96 of the frame 91. The air cylinders 104 are under the control of the control system and can be individually pressurized to move a particular belt assembly from its non-feeding position to its feeding position. The idler belt on each of the frame members 91 extends around idler sprockets 118 which are mounted for free rotation on a fixed shaft 114 and an adjustable shaft 116. The fixed shaft is supported between an ear 120 and a ledge 122 on the front rail 96 of the associated frame 91. The adjustable shaft 116 is mounted in a U-shaped bracket 124 having spaced-apart arms 126 between which the shaft is mounted and a laterally extending arm 128 which is adjustably secured to the front rail 96 by a fastener 130. The tension of the idler belt can thus be adjusted by simply loosening the fastener and moving the bracket 124 until the desired amount of belt tension is achieved. A support block 132 is also secured to the ledge 122 to provide a support for the portion of the belt which is against the driven belt during a feeding operation.

The wire guiding section 28 (FIGS. 4 and 9), by means of which any one of the six wires are guided to the single wire passageway 148 and the wire cutter 14, 16, comprises a generally wedge shaped center block 134 and two outside blocks 136 which are mirror images of each other. The blocks are secured to each other by suitable fasteners 138 and are secured to the plate 20 by fasteners 140. The outside blocks 136 have converging opposed surfaces 142 which merge with flat surfaces 144 that are against each other when the blocks are in assembled relationship. Channels 146 are provided in each of the surfaces 142 and extend from a location adjacent to the ends of wires in the feeding section to a single wire passageway 148. The passageway 148 in turn is formed by channels in the opposed flat surfaces 144. All of the channels 146 converge towards the single wire passageway 148 and merge with the single wire passageway so that a wire fed through any one of the channels enters the passageway and is guided to the wire outlet 150. The outlet is on the face 152 of the wire guiding assembly and the downstream wire clamp 30 is secured to the guiding assembly adjacent to this face. The blocks 134 and 136 are advantageously of a graphite filled polyester material in order to facilitate movement of the wires therethrough during a feeding cycle.

The downstream wire clamp 30 comprises a pair of spaced-apart, L-shaped fingers 154 which are mounted on arms 156 of a pneumatically controlled parallel motion gripper 158. The arrangement is such that when the arms 156 move towards each other, the arms 154 will move against each other and grip a wire located therebetween. The parallel motion gripper 158 may be of any suitable type, for example, a model RP 10 manufactured by Robohand Incorporated of 171 Spring Hill Road, Trumbull, CT. The gripper 158 is secured by fasteners 162 to an adapter block 160 which in turn is secured to the top surface of the guide block assembly.

To briefly review the operation during a single feeding cycle, the upstream wire clamps will normally be closed onto the wires, the downstream wire clamp will be open, and all of the idler belt assemblies will be retracted so that the idler belts will be in their non-feeding positions. When a command is received by the apparatus to feed a specific one of the six wires, the appropriate idler belt assembly is moved from its non-feeding position to its feeding position and the associated upstream wire clamp is open so that the wire is free to be fed. The driven belt is thereafter moved in the appropriate direction to cause feeding of the wire, from right to left as viewed in FIG. 3, through the guide assembly 28, from the wire outlet and through the downstream wire clamp 30. After feeding, the cutter is actuated to cut the wire and the direction of movement of the driven belt is reversed to withdraw the wire to its starting position so that a different wire may be fed during the next operating cycle.

The operating cycle as described above refers only to the wire feeding apparatus itself. When the apparatus is part of a harness making or lead making machine, the downstream wire clamp 30 will be closed prior to retraction of the wire and the entire feeding apparatus will be rotated on a vertical axis to present the cut end of the wire to a crimping press. Thereafter, the same wire, which now has a terminal on its end, is fed again to produce a lead. Only when a different wire is to be fed in the subsequent feeding operation is the wire which has been fed retracted to its initial position.

A typical control system for the apparatus is shown in FIG. 12. This control system is of the type which permits the production of a wide variety of different leads during several wire feeding cycles. The system shown comprises an input unit 168 such as a touch screen or a keyboard, a computer 170, and a data bank 172. The data bank will usually be part of the computer but is shown as a separate unit for purposes of explanation. When an operator 174 wishes to produce a particular harness requiring several different wires selected from the array of wires in the machine, he provides the necessary intelligence by line 176 to the input unit 168. The input unit 168 in turn transmits the information by line 178 to the computer 170 which in turn calls upon the data bank, as indicated by line 180, for the necessary information. The information is transmitted by line 182 back to the computer which in turn displays it on the screen 168 as indicated by line 183. When the operator 174 receives this information via line 185, he makes any necessary adjustments or changes to the machine as indicated by line 186. Changes for example, might require that a different or other wire be provided to the machine for a particular harness. After the changes have been made, the operator sets the computer in motion as indicated by the lines 188 and 189 which in turn controls the operation of the machine as indicated by line 190.

It will be apparent from the foregoing description that a machine in accordance with the invention is capable of feeding any one of a plurality of wires and locating the end of a wire which has been fed in one predetermined position. The feeding section, including the belts and the actuating means, can be used under circumstances other than those shown and described; for example, where it is not required to have the end of the fed wire in the one position at the outlet of the passageway. Also, the guiding system can be used with feeding systems other than the system shown.

We claim:

1. A wire feeding unit for selectively feeding either one of a first wire and a second wire, the wires being in parallel relationship, the wire feeding unit being characterized in that:

first, second, and third endless feeding surfaces are provided, the feeding surfaces being in side-by-side relationship with the third feeding surface being between the first and second feeding surfaces, the first and third surfaces having first opposed portions which function as first wire feeding portions, the first wire being between the opposed portions of the first wire feeding portions, the second and third surfaces having opposed portions which function as second wire feeding portions, the second wire being between the opposed portions of the second wire feeding portions, each of the feeding surfaces being movable along its length in both directions of its length, the opposed portions of each of the first and second wire feeding portions being relatively laterally displaceable towards and away from each other between a feeding position and a non-feeding position, the opposed portions of each of the wire feeding portions being against each other when in the feeding position and being spaced apart when in the non-feeding position, actuating means are provided for displacing either of the first and second feeding portions to their feeding positions and for moving one of the endless surfaces which is in its feeding position along its length whereby, either one of the wires can be selectively fed in a common direction by displacing the wire feeding portions which are associated with the one wire to their feeding position and thereafter moving one of the associated surfaces along its length.

2. A wire feeding unit as set forth in claim 1 characterized in that each of the endless feeding surfaces comprises an endless belt.

3. A wire feeding unit as set forth in claim 1 characterized in that the third endless feeding surface is a driven surface and the first and second endless surfaces are idler surfaces, the actuating means being effective to move only the third feeding surface along its length.

4. A wire feeding unit as set forth in claim 3 characterized in that wire guide means are provided for guiding the wires during feeding, the wire guide means being in alignment with the first and second wires and having convergent portions and a single wire passageway which extends to a wire outlet, the convergent portions extending to, and converging at, the single wire passageway whereby the wires are fed from the single wire outlet.

5. A wire feeding unit as set forth in claim 4 characterized in that a wire cutter is provided proximate to the wire outlet, the actuating means comprising cutter control means for actuating the cutter after a selected wire has been fed past the wire cutter.

6. A wire feeding unit as set forth in claim 5 characterized in that the actuating means comprises wire feed control means for moving the driven surface in one direction which will result in the feeding of a selected wire in the common direction during a feeding interval and for moving the driven surface in the direction which is opposite to the one direction at the conclusion of a feeding interval whereby after a selected wire has been fed and cut by the wire cutter, the selected wire can be retracted through the wire outlet and through the single wire passageway.

7. Wire feeding apparatus for selectively feeding one wire selected from either one of a first wire pair and a second wire pair, the first wire pair comprising a first pair first wire and a first pair second wire, the second wire pair comprising a second pair first wire and a second pair second wire, the feeding apparatus comprising:

first and second feeding units for the first pair and the second pair respectively, each of the feeding units having a single endless driven surface and first and second endless idler surfaces, the driven surface and the first and second idler surfaces being in side-by-side relationship with the driven surface being between the first and second idler surfaces, the first wire of the wire pair associated with each feeding unit being between the first idler surface and the driven surface, the second wire being between the second idler surface and the driven surface, each of the idler surfaces being freely movable along its length, actuating means are provided for moving the driven surface along its length in either of the directions of its length and for displacing each of the first and second idler surfaces, as units, laterally relatively towards and away from the driven surface between a feeding position and a non-feeding position, the idler surfaces being spaced from the driven surface when in the non-feeding position and being against the driven surface when in the feeding position, the first and second feeding units being in stacked and aligned relationship with the endless driven surface and the first and second idler surfaces of the first unit being beside the endless driven surface and the first and second idler surfaces of the second unit respectively whereby, the wires can be selectively fed, one at a time, in a common direction along parallel wire feed paths by displacing the idler surface which is associated with the selected wire of the selected pair to its feeding position and moving the driven feeding surface in the direction which will result in the feeding of the selected wire in the common direction.

8. Wire feeding apparatus as set forth in claim 7 characterized in that wire guide means are provided adjacent to the first and second feeding units, the guide means extending in the common direction from the feeding units, the wire feed paths for all of the wires extending into the guide means and having convergent feed path portions, a single wire passageway in the guide means extending to a wire outlet, the convergent feed path portions converging at the single wire passageway whereby, a selected wire which is fed from the apparatus is fed through the single wire passageway and through the wire outlet.

9. Wire feeding apparatus as set forth in claim 8 characterized in that a third feeding unit is provided for selectively feeding one wire selected from a third wire pair, the third feeding unit being in stacked aligned relationship with the first and second feeding units.

10. Wire feeding apparatus as set forth in claim 8 characterized in that a wire cutter is provided proximate to the wire outlet, the actuating means comprising cutter control means for actuating the wire cutter after a selected wire has been fed through the wire outlet and past the wire cutter.

11. Wire feeding apparatus as set forth in claim 10 characterized in that the actuating means comprises wire feed control means for moving the driven surface, which is associated with a selected wire which is being fed, in the one direction which will result in the feeding of the selected wire in the common direction during a feeding interval, and for moving the driven surface in the direction which is opposite to the one direction at the conclusion of the feeding interval whereby, after a selected wire has been fed and cut by the wire cutter, the selected wire is retracted through the wire outlet and through the single wire passageway.

12. Wire feeding apparatus as set forth in claim 11 characterized in that a downstream, relative to the common direction of wire feed, wire clamp is provided, the wire cutter being between the wire outlet and the downstream wire clamp, the downstream wire clamp being normally open, the actuating means comprising means for closing the downstream wire clamp after a selected wire has been fed in the common feeding direction past the wire cutter.

13. Wire feeding apparatus as set forth in claim 12 characterized in that a plurality of upstream wire clamps are provided for clamping wires which are not being fed while a selected wire is being fed.

14. Wire feeding apparatus as set forth in claim 8 characterized in that each of the feeding units comprises a driven assembly and first and second idler assemblies, each of the assemblies having a periphery, the driven surface being on the periphery of the driven assembly, the first and second idler surfaces being on the peripheries of the first and second idler assemblies respectively.

15. Wire feeding apparatus as set forth in claim 14 characterized in that the driven assembly of each unit comprises a pair of spaced-apart rotatable wheels, an endless driven belt extending around the wheels, the driven surface being a surface of the driven belt, the actuating means comprising means for rotating one of the wheels, the first and second idler assemblies comprising idler wheels and idler belts, the first and second idler surfaces being surface portions of the idler belts.

16. A wire feeding apparatus for selectively feeding one wire selected from a plurality of wires, the wire feeding apparatus comprising a plurality of individual wire feeding means, one feeding means being provided for each of the wires, and actuating means for selectively actuating any one of the feeding means, the wire feeding apparatus being characterized in that:

a wire guide means is provided adjacent to the wire feeding means, the wire guide means having a plurality of individual wire guiding portions which are in alignment with wires in the wire feeding means, a single wire passageway is provided in the wire guide means which is spaced from the wire feeding means and which extends to a single wire outlet, the individual wire guiding portions having convergent portions extend convergently to, and which converge at, the single Wire passageway whereby, individual wires are fed by the wire feeding means are fed to and through the single wire passageway and through the wire outlet.

17. A wire feeding apparatus as set forth in claim 16 characterized in that a wire cutter is provided adjacent to the wire outlet for cutting a wire fed from the outlet at the conclusion of a feeding interval.

18. A wire feeding apparatus as set forth in claim 17 characterized in that each of the individual feeding means comprises means for feeding its associated wire in one direction through the wire guiding portions and through the single wire outlet and means for retracting its associated wire from the single wire passageway and from the wire guiding portions.

19. A wire feeding apparatus as set forth in claim 18 characterized in that the actuating means comprises means for, during each operating cycle, causing a selected one of the feeding means to feed its associated wire in one direction through the wire guide means and past the wire cutter, for actuating the wire cutter thereby to cut the wire which has been fed, and for thereafter retracting the fed wire through the guide means thereby to permit feeding of a different wire during a subsequent operating cycle.

20. A wire feeding apparatus as set forth in claim 19 characterized in that the apparatus is capable of feeding at least four wires, the axes of the wires being parallel to each other and being aligned with each other in mutually perpendicular planes.

* * * * *